US006276534B1

(12) United States Patent
Huang et al.

(10) Patent No.: US 6,276,534 B1
(45) Date of Patent: Aug. 21, 2001

(54) CLASSIFIER APPARATUS FOR PARTICULATE MATTER/POWDER CLASSIFIER

(75) Inventors: Ching-Chung Huang, Summit; Joseph M. Pavlosky, Basking Ridge, both of NJ (US)

(73) Assignee: Hosokawa Micron Powder Systems, Summit, NJ (US)

( * ) Notice: Subject to any disclaimer, the term of this patent is extended or adjusted under 35 U.S.C. 154(b) by 0 days.

(21) Appl. No.: 09/280,043

(22) Filed: Mar. 26, 1999

Related U.S. Application Data

(60) Provisional application No. 60/080,525, filed on Apr. 3, 1998.

(51) Int. Cl.[7] ..... B07B 4/02

(52) U.S. Cl. ..... 209/139.2; 209/714; 209/713; 209/710; 209/143; 209/150

(58) Field of Search ..... 209/139.2, 142, 209/143, 710, 146, 134, 135, 713, 714, 154, 150

(56) References Cited

U.S. PATENT DOCUMENTS

| | | | | |
|---|---|---|---|---|
| 82,431 | * | 9/1868 | Mills et al. | 209/150 |
| 1,987,615 | * | 1/1935 | Fraser | 209/139.2 |
| 2,188,634 | | 1/1940 | Sturtevant | 209/139 |
| 2,529,679 | * | 11/1950 | Dodds | 209/150 |
| 2,542,095 | * | 2/1951 | Rouget | 209/714 |
| 2,546,068 | * | 3/1951 | Gustavsson | 209/714 |
| 2,694,492 | * | 11/1954 | Rumpf et al. | 209/714 |
| 2,796,173 | | 6/1957 | Payne et al. | 209/144 |
| 2,943,734 | * | 7/1960 | Payne et al. | 209/135 |
| 3,048,271 | * | 8/1962 | Sharples | 209/135 |
| 3,591,000 | * | 7/1971 | Humphreys | 209/210 |
| 3,670,886 | * | 6/1972 | Hosokawa et al. | 209/139.2 |
| 3,720,313 | | 3/1973 | Lapple | 209/144 |
| 3,767,045 | * | 10/1973 | Voelskow | 209/710 |
| 4,066,535 | | 1/1978 | Strauss | 209/139 |
| 4,100,061 | | 7/1978 | Eickholt et al. | 209/139 |
| 4,153,541 | * | 5/1979 | Rumpf et al. | 209/143 |

(List continued on next page.)

FOREIGN PATENT DOCUMENTS

| | | | | |
|---|---|---|---|---|
| 2431473 | * | 1/1976 | (DE) | 209/139.2 |
| 250066 | * | 9/1987 | (DE) | 209/714 |
| 780908 | * | 11/1980 | (SU) | 209/139.2 |
| 94/22599 | * | 8/1994 | (WO) | 209/714 |

OTHER PUBLICATIONS

Micron Powder Systems Brochure, *Acucut Ultrafine Air Classifers*, 1991.

*Primary Examiner*—Donald P. Walsh
*Assistant Examiner*—Daniel K Schlak
(74) *Attorney, Agent, or Firm*—Winston & Strawn

(57) ABSTRACT

A powder classifier which includes a classifier rotor fixedly secured to a rotatable shaft and having (i) an interior portion defined by upper and lower plates and (ii) an impeller wheel having upper and lower surfaces and a plurality of vanes therethrough. The upper plate has a rounded outer edge along its outer circumference, and the interior portion is in communication with a fine particle discharge outlet. First and second annular rings are concentrically disposed about the outer circumference of the classifier rotor, with the first annular ring being positioned so that a preclassification of a feed powder stream occurs at the first gap such that a fraction of fine particles is separated from the feed stream and flows through the first gap and into the interior portion of the classifier rotor for primary classification, A dispersion disk which rotates independently from the classifier rotor is provided to produce various degrees of dispersion intensities and disperses feed powders prior to classification. Also, air guide vanes are provided in the second annular ring to create vortex flow to achieve secondary classification for recovering fines.

25 Claims, 5 Drawing Sheets

U.S. PATENT DOCUMENTS

| | | | | |
|---|---|---|---|---|
| 4,388,183 | | 6/1983 | Thomas | 209/139 |
| 4,551,241 | * | 11/1985 | Saverse et al. | 209/135 |
| 4,560,471 | | 12/1985 | Yamada et al. | 209/144 |
| 4,564,442 | * | 1/1986 | Jager | 209/139.2 |
| 4,596,497 | | 6/1986 | Yamada et al. | 406/144 |
| 4,604,192 | | 8/1986 | Yamada et al. | 209/144 |
| 4,661,244 | | 4/1987 | Hanke et al. | 209/139.2 |
| 4,756,428 | * | 7/1988 | Jaeger | 209/135 |
| 4,759,943 | | 7/1988 | Ross, Jr. | 426/646 |
| 4,793,917 | * | 12/1988 | Eremin et al. | 209/143 |
| 4,799,595 | * | 1/1989 | Binder | 209/135 |
| 4,818,376 | * | 4/1989 | Tanaka et al. | 209/135 |
| 4,869,786 | | 9/1989 | Hanke | 209/139.2 |
| 4,919,795 | * | 4/1990 | Fujii et al. | 209/135 |
| 5,024,754 | | 6/1991 | Patzelt et al. | 209/135 |
| 5,263,589 | * | 11/1993 | Patterson | 209/33 |
| 6,109,448 | * | 8/2000 | Konetzka et al. | 209/135 |

* cited by examiner

A
B
1
2
3
3A
4
5
6
7
8
9
10
11
12
13
14
15
16
17
18
19
20
21
22
23
24
25
26
27
28
29
30
31
32
37
40
41
42
43
44
45
46
47
65
66
75
77

FIG. 3A
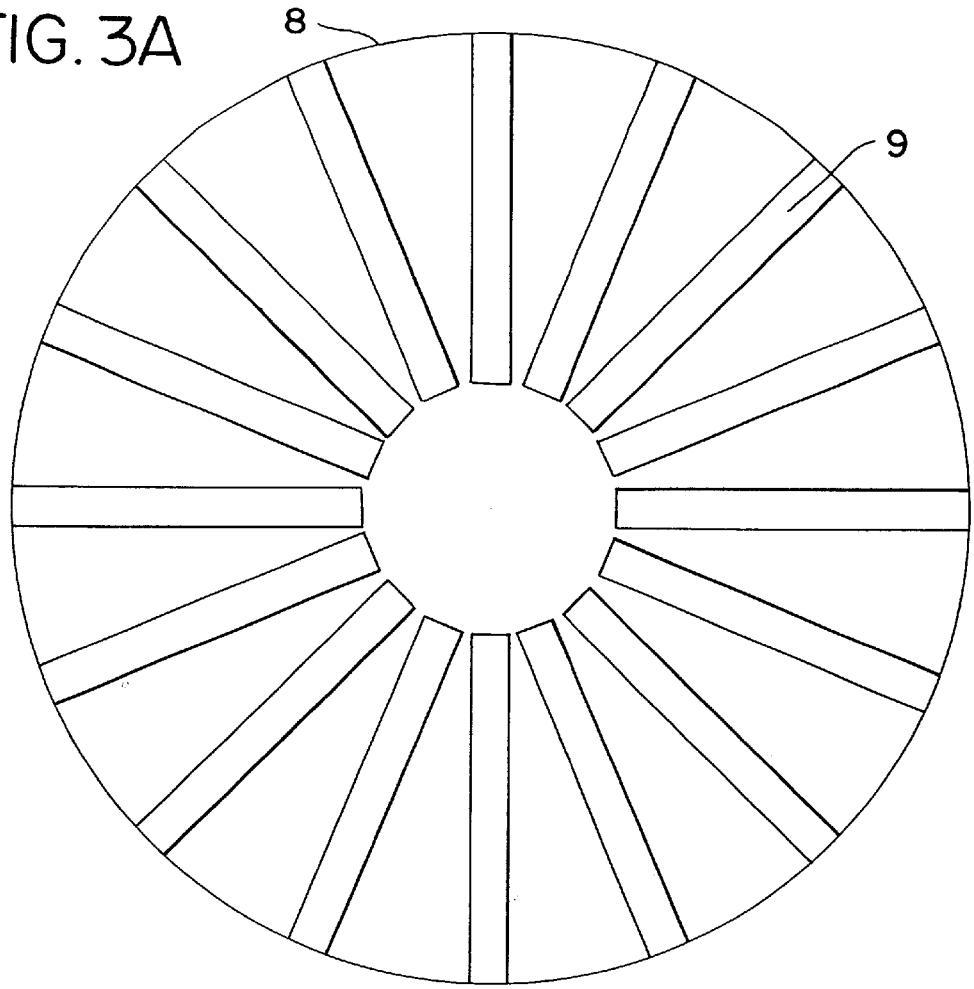
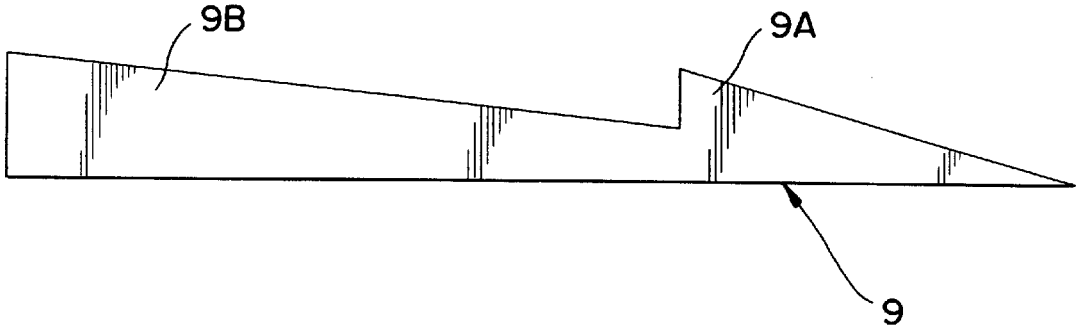
FIG. 3B

FIG. 5
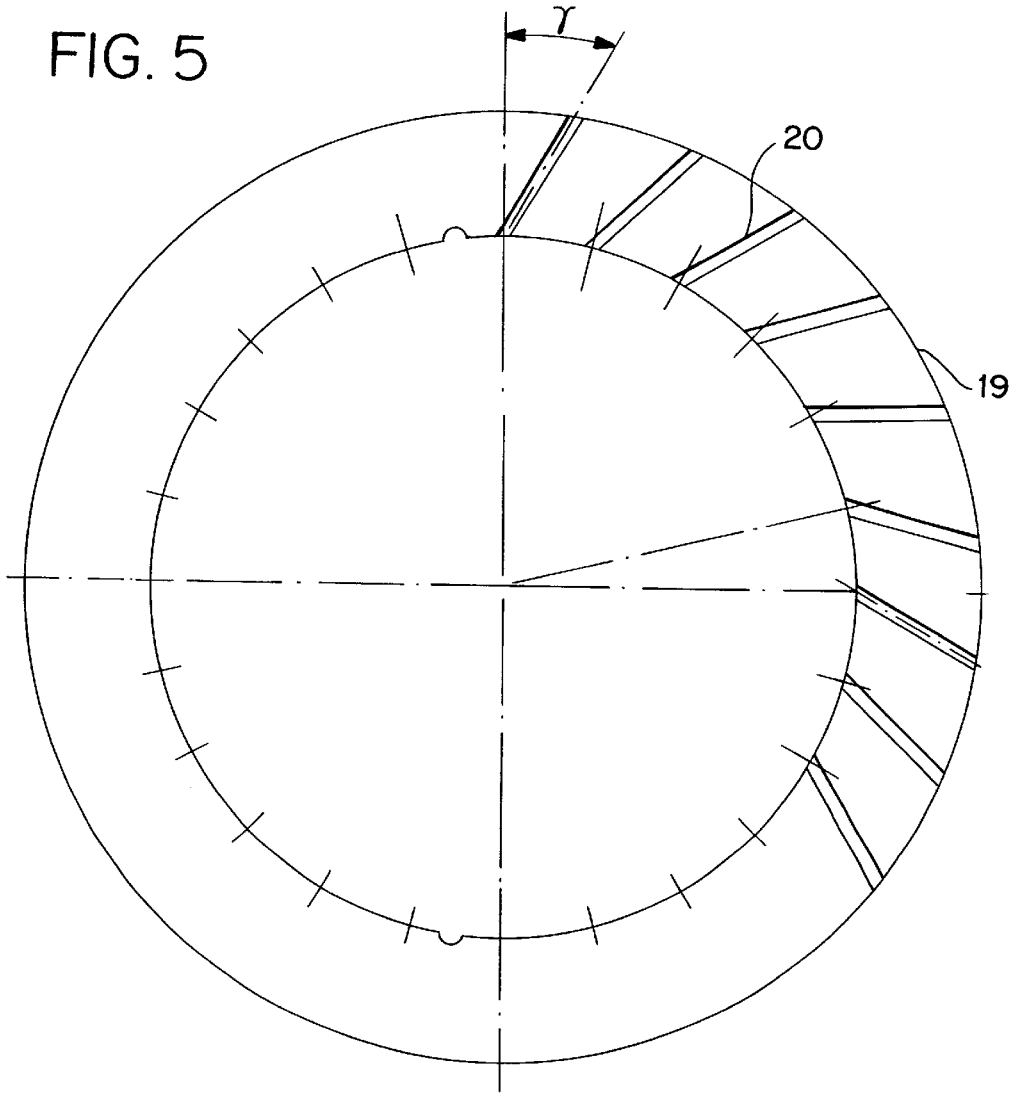
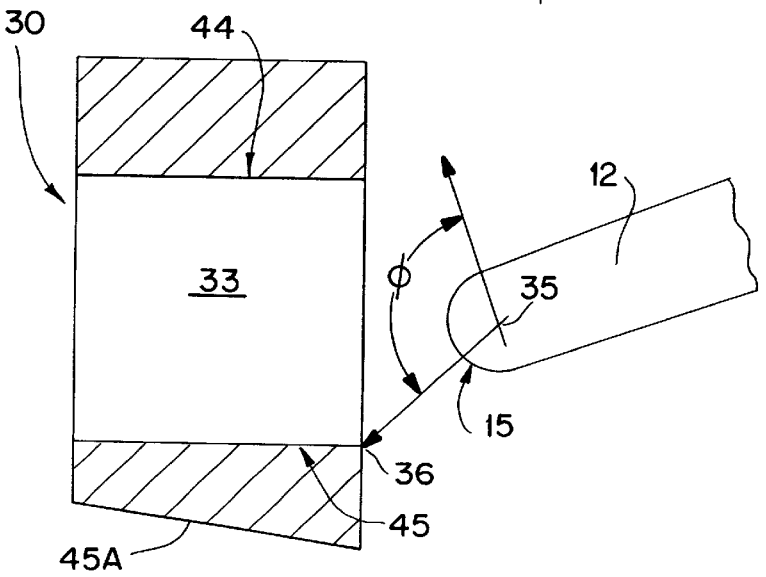
FIG. 4

CLASSIFIER APPARATUS FOR PARTICULATE MATTER/POWDER CLASSIFIER

CROSS REFERENCE TO RELATED APPLICATIONS

This application is a continuation-in-part of provisional application Ser. No. 60/080,525 filed Apr. 3, 1998.

BACKGROUND OF THE INVENTION

The present invention pertains to an apparatus for classifying powders. In general terms, classification of powders refers to the separation of a feed powder containing particles having a variety of particle sizes into a coarse fraction and a fines fraction in accordance with a selected "cut" size. One known method to evaluate the air classifier's cut size and sharpness is to construct a grade efficiency curve that plots size selectivity ($\eta_D$) versus particle size (D). The relationship can be calculated by analyzing the particle size distributions of the feed and final product to determine what percentage of a particle size in the feed goes into the coarse fraction. Size selectivity is defined as:

$$\eta_D = \frac{\text{Quantity of size } D \text{ entering course fraction}}{\text{Quantity of size } D \text{ in feed}}$$

The cut size ($x_{50}$) is the particle size corresponding to $\eta_D$=0.5 on the grade efficiency curve. Cut sharpness of the classification can be determined by intersecting the curve with the $\eta_D$=0.25 and $\eta_D$=0.75 lines and placing the particle sizes in the line intersections in relationship to each other. Cut sharpness ($x_{25}/x_{75}$) is often used to quantify air classifier performance. $x_{50}$ is the equiprobable cut size, i.e., the particle sizecorresponding to the 0.5 size selectivity value. $x_{25}$ is the particle size corresponding to the 0.25 size selectivity value. $x_{75}$ is the particle size corresponding to the 0.75 size selectivity value. Cut sharpness values range from 0.0 (almost no classification) to 1.0 (ideal but not achievable classification). In a production operation, an air classifier's cut sharpness typically ranges between 0.3 and 0.7. For a laboratory scale classifier, the cut sharpness can reach about 0.9. A good classifier has a wide adjustable cut size range and can achieve a very fine cut size and high cut sharpness.

There are a number of prior art references directed towards powder classifying apparatuses and methods. In general terms, most prior art powder classifiers comprise a means for dispersing the feed powder and a means for separating the dispersed powder at a specified cut size in order to obtain a coarse and a fines fraction. The prior art takes a variety of approaches in order to achieve the desired classification.

For example, a number of references disclose classifiers which employ the same basic design concept wherein a dispersion disk(s) is used to initially break up the feed powder and subsequently a classifying means such as a rotor is employed to impart a centrifugal force to the particles. The classification is typically achieved by applying a current of air to the dispersed powder stream, whereby the fine particles are removed from the particle stream by the air current and directed to a fines discharge outlet and the coarse particles travel through the air current and into a coarse particle discharge outlet. Among the references which describe variations of this basic design concept include U.S. Pat. Nos. 2,188,634; 2,542,095; 2,796,173; 3,720,313; 4,066,535; 4,100,061; 4,066,535; 4,388,183; 4,560,471; 4,604,192; 4,759,943; 4,869,786; and 5,024,754.

The references cited above provide a variety of designs in an attempt to optimize the same basic design concept. For example, some of the above references disclose designs wherein the current of air directs the fines inwardly towards the center of the classification chamber. see e.g. U.S. Pat. Nos. 4,560,471; 4,759,943; 2,796,173; 4,869,786 Others of the references disclose designs wherein the current of air directs the fines to an outer portion of the classifying chamber. see e.g. U.S. Pat. No. 4,066,535; 4,388,183. Many of the prior classifiers disclosed in the above references exploit the effects of gravity in that upon classification of the powder, the fines fraction and the coarse fraction are directed to separate discharge ports located in the bottom portion of the classifier housing. see e.g. U.S. Pat. Nos. 4,066,535; 4,388,183; 4,560,471; 4,759,943, 5,024,754. However, there are some prior art classifiers wherein the fine material is lifted upwardly against the force of gravity and is discharged from the upper portion of the classifier. see e.g. U.S. Pat. No. 4,661,244. A number of the references mentioned above disclose classifier systems wherein the dispersion means and the classifying means are separately driveable in order to achieve optimum particle dispersion and classification. see e.g. U.S. Pat. Nos. 5,024,754; 4,869,786; 4,661,244; 4,388,183; 4,100,061; 2,188,634.

However, there remains a need for an improved powder classifier which allows for control of a number of variables in order to obtain a more precise cut of the coarse fraction and fines fraction while also maintaining a high throughput of the feed powder. The present invention provides a novel design for such a classifier, the features of which are not disclosed or suggested by any of the prior art classifiers, either alone or in combination.

SUMMARY OF THE INVENTION

The present invention provides an improved powder classifier which provides a precise classification of a feed powder stream into a coarse fraction and a fines fraction, while also allowing a high throughput of the feed powder. The improved powder classifier of the present invention employs a powder dispersion, preclassification, secondary classification and primary classification in order to obtain the precise classification of the feed material.

In particular, the present invention is directed to a powder classifier which comprises a classifier rotor fixedly secured to a rotatable shaft and having (i) an interior portion defined by an upper plate and a lower plate, and (ii) an impeller wheel having upper and lower surfaces and a plurality of vanes therethrough. The vanes form a plurality of channels through the impeller wheel, the upper plate has a rounded outer edge along its outer circumference, and the interior portion is in communication with a fine particle discharge outlet. The powder classifier also includes a first annular ring having an inner circumference, an outer circumference, an upper surface and a lower surface, the first annular ring being disposed about the outer circumference of the classifier rotor, and a first gap formed between the inner circumference of the first annular ring and the outer circumference of the classifier rotor, with the first annular ring being positioned so that a preclassification of a feed powder stream occurs at the first gap such that a fraction of fine particles is separated from the feed stream and flows through the first gap and into the interior portion of the classifier rotor for primary classification.

In this device, it is preferred to provide a transition portion beneath the first annular ring with an inwardly tapered configuration in order to enhance particle separation therein. With this design, the first annular ring may be a solid ring having upper and lower surfaces where the lower surface includes the inwardly tapered configuration.

The powder classifier may also include a second annular ring having an inner circumference, an outer circumference, an upper surface and a lower surface, wherein the second annular ring is disposed about the outer circumference of the first annular ring. Preferably, the second annular ring has a plurality of air guide vanes located between the upper surface and lower surface thereof, with the air guide vanes forming a plurality of channels through the second annular ring. Advantageously, these air guide vanes are evenly spaced from each other and positioned such that a radial vector projecting from the center of the classifier rotor intersects a vector projecting along the centerline of an air guide vane to form angle $\beta$ which is between about 60 to 90°.

When the first annular ring includes a hollow central opening, it is advantageous for a second gap to be formed between the outer circumference of the first annular ring and the inner circumference of the second annular ring. This is done by positioning the first annular ring in relation to the second annular ring in order to obtain a secondary classification at the inner circumference of the second annular ring to separate coarse particles from fine particles. In this arrangement, the first annular ring generally includes a plurality of powder directional vanes located between the upper surface and lower surface thereof, with the powder directional vanes forming a plurality of channels through the first annular ring. The powder directional vanes may be evenly spaced from each other and positioned such that a radial vector projecting from the center of the classifier rotor intersects a vector projecting along the centerline of a powder directional vane to form an angle $\alpha$ which is between about 0 and 90°.

The rotatable shaft is preferably a coaxial shaft having an inner shaft and an outer hollow shaft, with separate drive means being used for the inner shaft and the outer shaft. A rotary dispersion disk secured to the inner shaft by a first hub assembly is advantageously used to help disperse the incoming feed material, and a plurality of dispersion blades are positioned on the upper surface of the disk. The classifier rotor is secured to the outer hollow shaft by a second hub assembly. The upper and lower plates of the classifier rotor are generally circular in shape, and are connected by the second hub assembly. A preferred arrangement includes configuring the upper plate with a downwardly sloping annular outer portion while configuring the lower plate with an upwardly sloping annular outer portion. The downwardly sloping annular outer portion of the upper plate terminates at the rounded edge which preferably has a semicircular profile.

The powder classifier includes a housing within which the classifier rotor, first annular ring and second annular ring are disposed, and at least one opening in the housing for introducing air therein. If desired, a plurality of openings for introducing air may be provided in the housing. The classifier rotor comprises an impeller wheel with the vanes that extend through the impeller wheel being canted and positioned at an angle $\gamma$ of about 0° to about 45° from the radial direction of the impeller wheel. A plurality of air distribution fins located on the lower surface of the lower plate of the classifier rotor may be used to help introduce air into the housing and to serve as a mechanical seal mechanism for bearings. A circumferential slot, rather than a plurality of openings may be used for uniform distribution of air into the housing and through the second annular ring.

The first annular ring is advantageously positioned relative to the classifier rotor such that an angle $\phi$ is formed by the intersection of a radial vector projecting from the center point of the semi-circle and a vector projecting from the center point and intersecting an innermost edge of the lower surface of the first annular ring. This angle $\phi$ is between about 30° to about 170°, and preferably about 50° to about 150°. A feed inlet is typically used for introducing feed material into the housing, but in the present invention it advantageously includes an adjustable opening for introducing air into the feed inlet.

A cyclone operatively associated with the second annular ring may be used for collecting and removing coarse particles. This cyclone can have an adjustable inlet opening which includes a wall member that is positionable at different angles with regard to the inner circumference of the second annular ring to optimize collection and removal of the coarse particles. In addition, an air jet can be positioned in relation to the cyclone opening to assist in the recovery of coarse particles. Preferably, the lower surface of the first annular ring is located below the upper surface of the second annular ring, and wherein the first gap is from about 1 mm to about 5 mm wide and the second gap is from about 6 mm to about 16 mm wide.

Another embodiment of the invention relates to a method of classifying a feed powder containing a plurality of coarse particles and fine particles. This method includes the steps of preclassifying the feed powder into a first coarse particle fraction and a first fine particle fraction; classifying the first fine particle fraction to recover fine particles and to remove remaining coarse particles; recovering the remaining coarse particles; classifying the first coarse particle fraction to recover coarse particles and to separate remaining fine particles; and recovering the remaining fine particles. The feed powder may be dispersed into the device prior to being preclassified.

BRIEF DESCRIPTION OF THE DRAWINGS

FIG. 3A is a top view along line B—B of FIG. 1, illustrating the dispersion disk.

FIG. 3B is a vertical cross-sectional view of a preferred embodiment of dispersion blades 9.

FIG. 4 is an exploded view of the rounded edge of the upper plate and the lower surface of the first annular ring.

FIG. 5 is a top view along line A—A of FIG. 1, illustrating the impeller wheel.

DETAILED DESCRIPTION OF INVENTION

Figure 1:
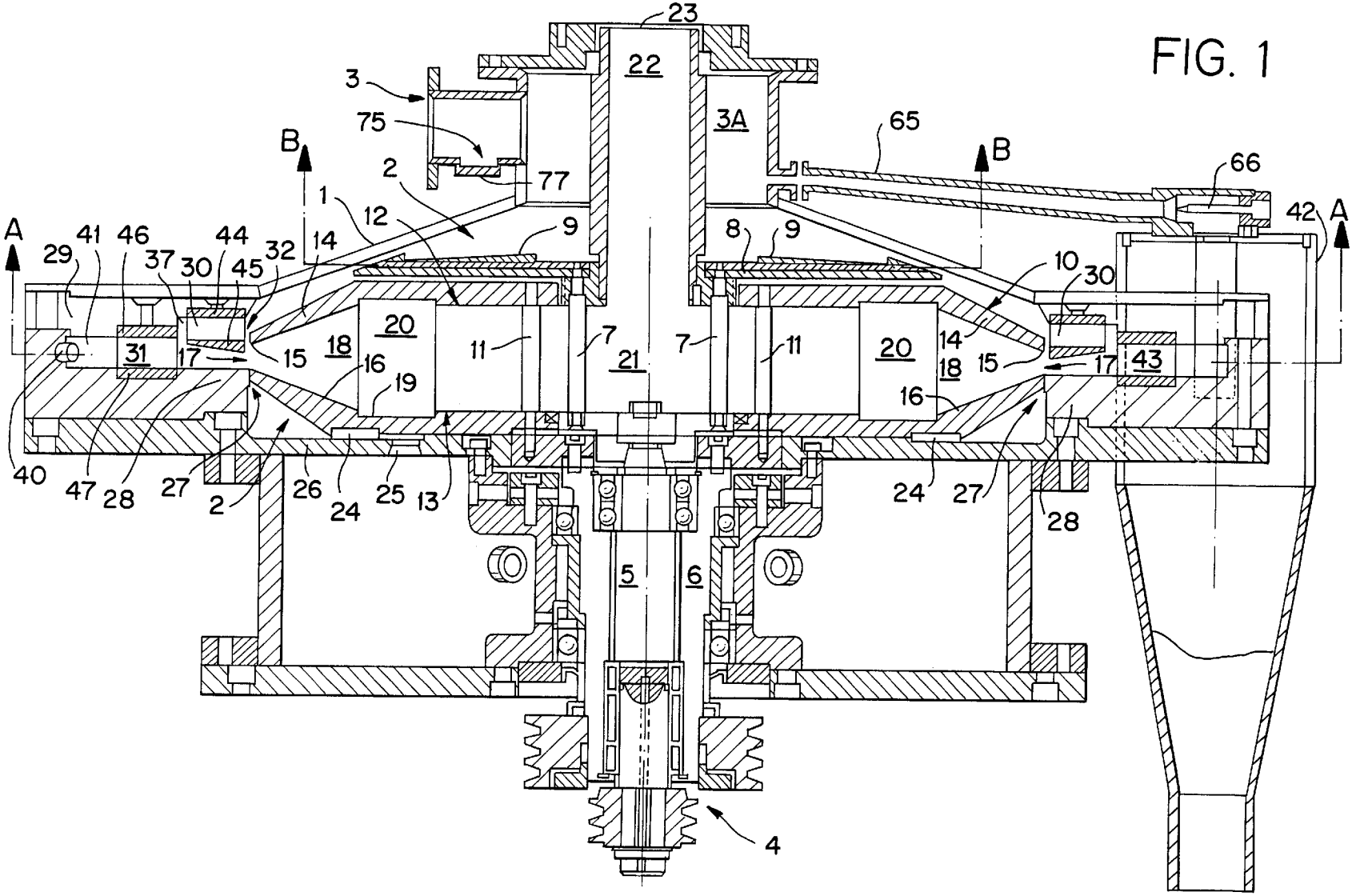
FIG. 1 is a vertical cross-sectional view of one embodiment of a powder classifier in accordance with the present invention.

The powder classifiers of the present invention can be employed to classify essentially any powdered materials. Examples of suitable powdered materials include but are not limited to ceramics, minerals, catalysts, metals, alloys, plastics, food products, specialty chemicals, pharmaceuticals, polymers, toners, pigments, powder coatings, and the like. Such materials have a wide range properties, including a variety of average particle sizes and particle size distributions. The classifiers of the present invention provide a precise classification of such powders into a coarse fraction and a fines fraction of desired particles sizes while also allowing a high throughput of material through the classifier.

The particle size of the desired cut between the coarse fraction and the fines fraction produced by the classifiers of the present invention may range from about 0.5 μm to about 50 μm, preferably 0.5 μm to about 25 μm and more preferably about 0.5 μm to about 10 μm. As discussed below, there are a number of parameters involving the classifiers of the present invention that may be selected and controlled in order to optimize the sharpness of the cut achieved. The classifiers of the present invention should achieve a cut sharpness of about 0.6 to about 0.9, depending upon the throughput of feed powder in a production scale.

A first embodiment of the present invention is illustrated in FIGS. 1–4. The powder classifier illustrated in the FIG. 1 has a vertical axis and has an outer housing 1 which forms an interior chamber 2. A raw material inlet 3 is located at an upper portion of the housing and provides a means for introducing the material to be classified. A rotatable coaxial shaft 4 having an inner solid shaft 5 and an outer hollow shaft 6 is located along the vertical axis. A rotary dispersion disk 8 is secured to a first hub assembly 7 which comprises a cage-like structure which allows powder to flow therethrough and in a manner such that the dispersion disk may be removed and replaced easily. The first hub assembly 7 is secured about the inner solid shaft of the coaxial shaft. Preferably, an easily released locking mechanism is used to secure the first hub assembly to the inner shaft.

The upper surface of dispersion disk 8 includes a plurality of replaceable dispersion blades 9. As shown in FIG. 3A, these dispersion blades 9 are positioned in a radial configuration so as to evenly distribute and disperse the incoming powder stream within the interior chamber 2. The number of dispersion blades 9, as well as shape and dimensions thereof may vary depending the desired degree of dispersion and the characteristics of the material to be dispersed. As noted above, the dispersion disk 8 is secured to the coaxial shaft by first hub assembly 7 in such a manner that it may be removed and replaced, preferably with relative ease. Further, it is preferable that the dispersion blades 9 are secured to the dispersion disk in such a manner that they may be removed and replaced easily. As such, the design of the dispersion disk 8 and dispersion blades 9 may be selected in order to divide the incoming powder stream evenly into smaller streams and obtain optimum dispersion based on the characteristics of the specific feed powder stream to be dispersed. In one embodiment, as illustrated in FIGS. 3A and 3B, the 335 mm O.D. dispersion disk 8 has sixteen dispersion blades 9 comprising two successive, fin-like projections 9A, 9B. The number of blades is not critical, and can be varied as desired by the skilled artisan. As the incoming feed falls upon the rotating disk 8, the material is urged by centrifugal force toward the outer portions of the disk and housing. The material initially contact blade ridges 9B, which initially breaks up and disperses the material. Further outward movement of the material causes contact with blade ridges 9A which further breaks up and disperses the material.

Disposed below dispersion disk 8 is a rotatable classifier rotor 10. Classifier rotor 10 includes an upper plate 12 and lower plate 13. These plates 12,13 are secured to a second hub assembly 11 which is constructed to allow the powder to pass therethrough. The second hub assembly 11 is secured about the outer shaft 6. Both the upper plate 12 and the lower plate 13 are generally circular in shape. The upper plate 12 is generally planar, but has a downwardly sloping annular outer portion 14 so as to provide the plate with a generally downwardly concave cross-sectional profile. The outer edge 15 of the upper plate 12 is rounded, preferably comprising a semi-circular cross-sectional profile as illustrated in FIG. 4.

The lower plate 13 is also generally planar, but has an upwardly sloping annular outer portion 16 which provides the plate with a generally upwardly concave cross-sectional profile. Lower plate 13 is positioned such that an annular airflow gap 27 is formed between the outer edge of lower plate 13 and sidewall 28. Preferably air flow gap 27 is about 0.1 mm to about 0.5 mm in width and more preferably about 0.25 mm.

An opening 17 appears along the interface of the upper plate 12 and lower plate 13, wherein the opening 17 is in communication with primary classification zone 18 of the classifier rotor 10. Disposed between upper plate 12 and lower plate 13 is impeller wheel 19. Impeller wheel 19 comprises a plurality of canted vanes 20, which form a plurality of channels therethrough. The number of canted vanes 20, as well as the shape, dimensions and location thereof is not specifically limited so long as they achieve the effect of creating a vortex flow in primary classification zone 18, as well as allowing the fine particle fraction to pass through impeller wheel 19 into central hollow portion 21. In a preferred embodiment, there are 24 canted vanes for an 335 mm O.D. impeller wheel. These vanes may be positioned at an angle γ of about 0° to about 60° and preferably about 0 to about 45° with respect to the radial direction of the impeller wheel as illustrated in FIG. 5. The central hollow portion 21 is in communication with the interior of the rotatable hollow tube 22 which leads to fines outlet 23.

A plurality of air inlets 25 are located through the housing base 26. Preferably, there are a total of ten air inlets 25. If desired, a plurality of air distribution fins 24 may be located along the lower surface of the lower plate 13 to assist in evenly distributing the air entering through air inlets 25 under the classifier rotor and to serve as a mechanical seal for bearings. The number of air distribution fins 24, as well as the shape, dimensions and location thereof are not specifically limited and may comprise any of a number of configurations and locations so long as they evenly distribute the incoming air under the classifier rotor and protect the bearings. In a preferred embodiment, there are four air distribution fins 24 having a generally rectangular shape and spaced equidistant about the lower surface of the lower plate 13.

An annular plate 29 having a first annular ring 30 is disposed about the classifier rotor 10. If desired, the annular plate 29 may be attached to the cover of the classifier housing. The first annular ring 30 is located about the periphery of the upper plate 12 of the classifier rotor 10 such that a first gap 32 is formed. The width of first gap 32 is at least about 0.25 mm, preferably about 1 mm to about 5 mm and more preferably about 3 mm.

Figure 2:
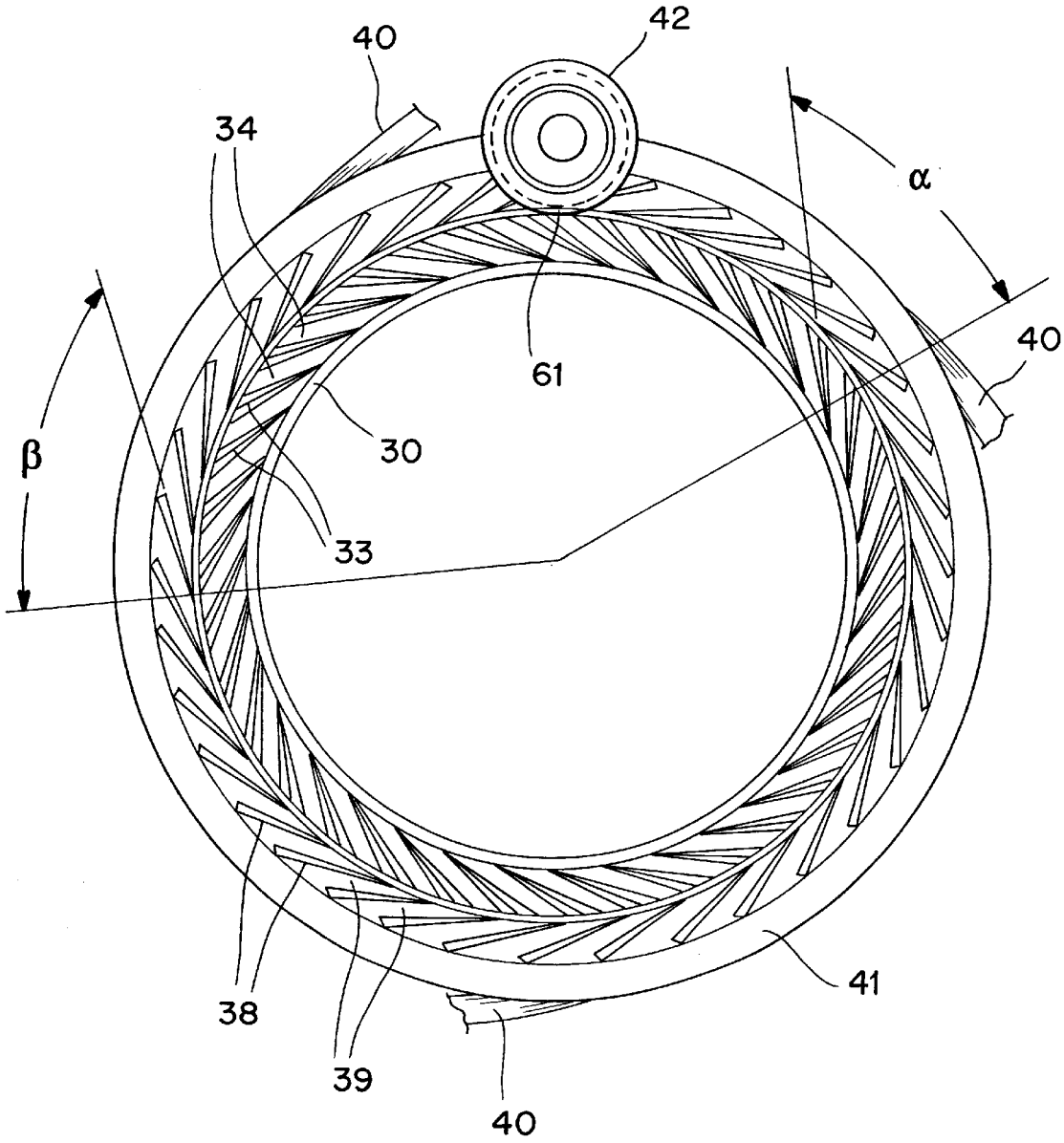
FIG. 2 is a top view along line A—A of FIG. 1, illustrating the classifier rotor, first annular ring and second annular ring of the powder classifier of FIG. 1.

The first annular ring comprises a top surface 44, a bottom surface 45 and a plurality of powder directional vanes 33 located therebetween (also see FIG. 4). The powder directional vanes 33 form a plurality of channels 34 for directing the coarse particles to the outer circumference of the classification chamber. The number of powder directional vanes 33, as well as the shape, dimensions and location thereof are not specifically limited and may comprise any of a number of configurations and locations so long as they direct the coarse particles through first annular ring 30 and towards the outer circumference of the interior chamber 2. In a preferred embodiment, there are thirty-six powder directional vanes 33 having a generally triangular footprint and spaced equidistant around a 527 mm O.D. annular ring. These vanes form an angle a as shown in FIG. 2. One of ordinary skill in the art can conduct routine tests to determine the optimum angle size for classification of any particular powder material.

As illustrated in FIG. 4, the first annular ring 30 is preferably located such that an angle $\phi$ is formed by a radial vector projecting from center point 35 of semicircular rounded edge 15 and a vector projecting from center point 35 and intersecting the inner edge 36 of the bottom surface 45 of first annular ring 30. Preferably angle $\phi$ is about 30° to about 170°, more preferably about 90° to about 150° and most preferably about 135°. Further, it is preferably that a convergent taper 45A be formed under the bottom surface 45 of the first annular ring to assist in the recovery of fines.

Located about the periphery of first annular ring 30 is a second annular ring 31 comprising a top surface 46 and a bottom surface 47, such that a second gap 37 is formed. Preferably, the width of second gap 37 is less than about 20 mm, more preferably about 6 mm to about 16 mm and most preferably about 12 mm. Preferably, the second annular ring 31 is positioned such that the top surface 46 is lower than top surface 44 of first annular ring 30 and above the bottom surface 45 of first annular ring 30, preferably by about 1–10 mm, more preferably by about 1 mm to about 5 mm and most preferably by about 3 mm.

Figure 6:
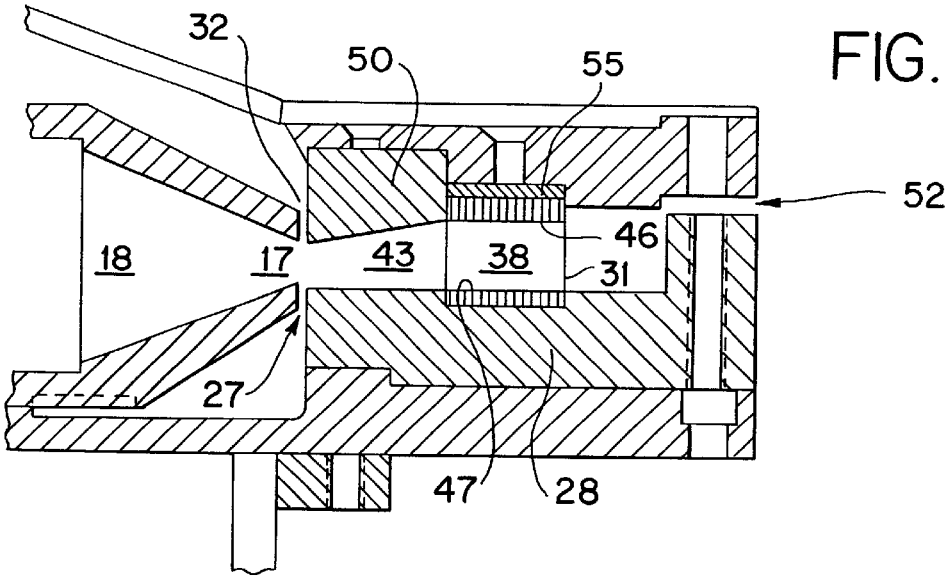
FIG. 6 is a vertical cross-sectional view of another embodiment of a powder classifier which utilizes a solid ring and an air gap or a peripheral slot in accordance with the present invention.

Alternatively, as shown in FIG. 6, a solid annular ring 50 can be provided. This ring has a tapered bottom surface like that of ring 30, and is used when relatively low air flow rate are necessary to achieve a more desirable pre-classification. When ring 50 is solid, no second gap 37 is present, and ring 50 is positioned as close as possible, and preferably in contact with, ring 31.

Located along the inner periphery of housing 1 are a plurality of air inlets 40, which provide a flow of air into an outer circumferential chamber 41 around the outer circumference of the second annular ring 31. The number of air inlets 40, as well as the shape, dimension and location thereof is not specifically limited and may comprise any number of configurations and locations so long as they develop uniform air flow through the second annular ring 31. In one preferred embodiment of the invention, the air inlets 40 are spaced equidistant from one another and each providing a flow of air that is generally tangential to the outer circumference of second annular ring 31.

Another alternative embodiment of the present invention is illustrated in FIG. 6. In this classifier, a circumferential slot 52 is provided along the periphery of the housing so that a uniform stream of air can be introduced into the interior of the housing. The shape and dimension of this slot 52 is not specifically limited and may comprise any configuration which provides uniform air flow. It is preferred that the total opening of the air inlets 40 or the slot 52 is no less than the total opening of the inner circumference of the second annular ring 31. Also, due to the configuration of the device, air is drawn into the housing during operation, and there is no concern of any particles exiting the housing through the air inlets. For special applications of classifying particles that require an inert gas to be introduced into the housing, a jacket can be provided around the outside of the housing and the desired inert gas or atmosphere can be introduced into the jacket and then into the housing through the inlets.

One way to easily provide the circumferential slot 52 is to insert a spacer or gasket 55 above the second annular ring 31 in the device. This spacer 55 should be made of an engineering plastic such as nylon or of a relatively hard elastomer so that the upper portion of the device is raised sufficiently to provide the slot. In a new device, the upper portion can be machined to the desired dimensions to provide the slot. Alternatively, the slot can be machined in any desired location in the sidewall of the housing provided that a uniform air flow is achieved.

The second annular ring 31 comprises a top surface 46, bottom surface 47 and a plurality of air guide vanes 38 located therebetween. The air guide vanes 38 form a plurality of channels 39 for directing the air flow entering from the air inlets 40 or the circumferential slot 52 through the second annular ring 31. The number of air guide vanes 38, as well as the shape, dimensions and location thereof is not specifically limited and may comprise any of a number of configurations and locations so long as they achieve the object of directing the air flow from air inlets 40 or circumferential slot 52 through channels 39 to form an inward vortex flow about the inner circumference of second annular ring 31, thereby providing a secondary classification of the feed powder. In a preferred embodiment, there are 68 air guide vanes having a generally triangular footprint and spaced equidistant around a 606 mm O.D. ring, such that a proper angle $\beta$ is formed as shown in FIG. 2.

As shown in FIG. 2, the powder directional vanes 33 are positioned such that an angle $\alpha$ is formed from the intersection of a vector projecting along the centerline of the powder directional vane 33 and a radial vector from the center of classifier rotor 10. Preferably, angle $\alpha$ is about 0° to about 90°, more preferably about 30° to about 80°, and most preferably about 60°. Likewise, the air guide vanes 38 are positioned such that an angle $\beta$ is formed from the intersection of a vector projecting along the centerline of the air guide vane 38 and a radial vector from the center of classifier rotor 10. Preferably, angle $\beta$ is at least about 60°, more preferably about 60° to about 90°, and most preferably about 86.5°.

Figure 7:
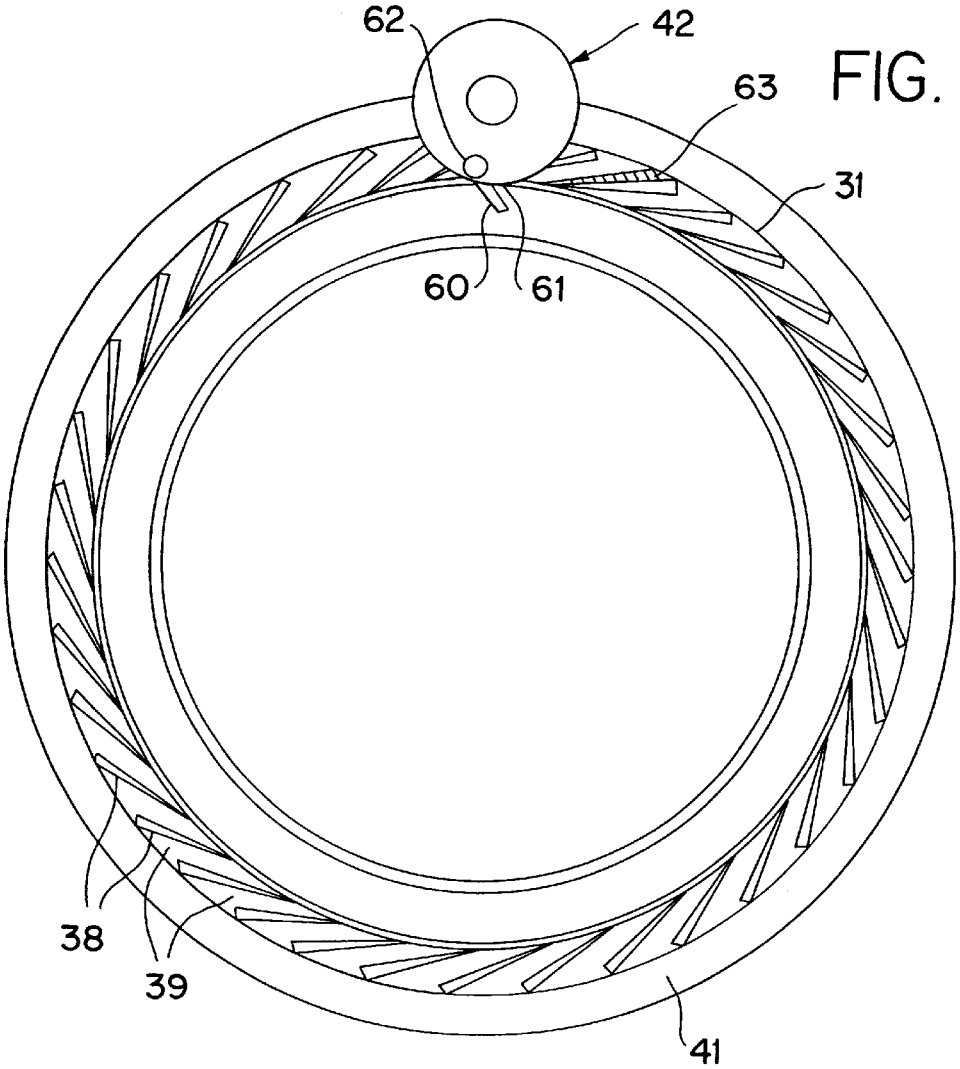
FIG. 7 is a top view taken generally along line A—A of FIG. 1, but illustrating another embodiment of the invention which utilizes an adjustable inlet and air jet for the cyclone.

Also located along the inner periphery of housing 1 is at least one coarse particle outlet 61 for obtaining the coarse particle fraction from the feed powder stream. Preferably, the coarse particle outlet 61 communicates with a cyclone 42, which preferably comprises an adjustable gate 60, as shown in FIG. 7. This gate 60 is preferably in the form of a wall member which is pivotably connected to the cyclone 42, such as by a set screw 62 which can be tightened to hold the wall member at a desired angle which intersects the inner circumference of second annular ring 31. This angle can vary from tangent (i.e., 0°) to that circumference to perpendicular to it (i.e., 90°), so as to allow control of the volume of coarse particles entering the cyclone. One of ordinary skill in the art can select the desired angle for the material that is to be classified by conducting routine tests. Generally, an angle of about 15 to 45° provides optimum recovery of the coarse particles. In addition, an air jet 63 located at a tangential position to the coarse particle outlet 61 can supply an air stream which assists in the recovery of the coarse particles.

A vacuum is preferably applied to rotatable hollow tube 22 is located such that it is in communication with the fines outlet 23. Also not shown in the Figures is a drive means for rotating the inner solid shaft 5 and the outer hollow shaft 6 of the coaxial shaft 4. It is preferable that solid shaft 5 and outer hollow shaft 6 each have separately controllable drive means.

Dust and fines are further recovered from the cyclone 42 by conduit 65 that communicates with the annular feed pipe 3A and the interior of the cyclone 42. This conduit 65 enables the vacuum, which is generated by a compressed air driven ejector 66, to aspirate the interior of the cyclone so that any dust or fine particles that are swirling around therein can be aspirated into the annular feed pipe 3A and then be classified again.

The operation of the above-described classifier of the present invention is described below. The dispersion disk 8 and the classifier rotor 10 are rotated at desired speeds. In order to provide improved control of the various parameters which influence powder dispersion and classification, the dispersion disk 8 and the classifier rotor 10 are preferably designed to be separable driveable, thereby permitting each to be rotated at either the same speed or at different relative speeds and directions. For example, in the embodiment discussed above, coaxial shaft 4 has an inner solid shaft 5 and an outer hollow shaft 6, thereby allowing dispersion disk 8 and classifier rotor 10 to each have independent drive means. Thus, dispersion disk 8 may be rotated at a selected speed in order to provide a desired degree of dispersion intensity, while the classifier rotor can be rotated at a second speed so as to obtain a fine particle fraction and a coarse particle fraction of specified particle sizes. As used herein, "speed" refers to the "tip speed" which is the speed of the outer edge of the rotating body (e.g., the dispersion disk or classifier rotor), typically measured in m/s.

A feed powder stream is introduced into feed inlet 3 which is in communication with dispersion disk 8 through annular feed pipe 3A. The feed powder is deposited onto the center region of the rotating dispersion disk 8 and is divided into smaller powder streams by the dispersion blades 9. Further, as a result of the centrifugal force imparted to the particles by the rotation of the dispersion disk 8, the feed powder is propelled toward the outer circumference of the dispersion disk 8. As noted above, dispersion disk 8 has a plurality of dispersion blades 9 on the upper surface thereof.

The edges of the dispersion blades 9 are designed to completely disperse the feed stream, breaking up any agglomerates into free particles and to "fan out" the particles so as to uniformly distribute the particles to the space above the sloping annular outer portion 14. The shape and dimensions of the dispersion blades 9 affect the dispersion intensity of the disk. Thus, when the powder feed stream is deposited onto dispersion disk 8, the powder is dispersed into a plurality of free particles which are directed in a circular flow pattern while also being propelled towards the outer circumference of the classifier rotor 10.

The dispersion disk 8 is removably secured to the first hub assembly 7 so that the disk may be easily removed and replaced. Therefore, the configuration of the dispersion disk 8 may be selected based on the characteristics of a given powder such as its particle size distribution, average particle size, degree of agglomeration, moisture content, etc., in order to obtain optimum dispersion of the feed powder. Although blades can be provided, a solid dispersion disk without blades can be used if desired.

The powder expelled from the dispersion disk 8 is directed along the downwardly sloping annular outer portion 14 of the upper plate 12 of the rotating classifier rotor 10 to the rounded edge 15 of upper plate 12 and across first gap 32. A pre-classification of the powder occurs at first gap 32, wherein a portion of the fines are directed around the rounded outer edge 15 and into first gap 32. The fines then travel through opening 17 and into primary classification zone 18 of the classifier rotor 10. The vacuum applied to the top of hollow tube 22 provides an inwardly flow of air through classifier rotor 10.

Without being limited to a single theory, it is believed that the pre-classification occurs as result of a particle flow principle known as a "cross flow separation effect." This effect refers to the observed phenomena that when a fluid stream of particles flows around a specially designed curvature, the particle stream tends to separate according to particle size. More specifically, it has been observed that the particles having the smallest diameter tend to flow closest to the specially designed curvature. As the diameter of the particles get progressively larger and larger, however, they tend to flow further and further away from the specially designed curvature. Thus, the present invention achieves a pre-classification by exploiting this phenomena with a rounded edge 15 at the circumference of the upper plate 12 of the classifier rotor 10.

In particular, the outer edge 15 of the upper plate of the classifying rotor is rounded into a semi-circle so that as the particle stream proceeds down the upper plate 12, a portion of the fines is directed around the rounded edge 15 and into the first gap 32 through opening 17 and into classification zone 18, while the remainder of the particle stream continues along to the first annular ring 30. The particle size of the fines fraction obtained in this first classification step is determined by a variety of parameters such as width of first gap 32, relative positioning of first annular ring 31 and rounded edge 15, the flow rate of the feed powder, the speed of the classifier rotor 10, and the extent of the vacuum applied to fines outlet 23, as well as the properties of the feed powder stream itself such as the particle size distribution and the extent of the dispersion thereof. These parameters may be modified in order to adjust the desired particle size of the fines fraction obtained by this preclassification step.

The particles in primary classification zone 18 are subjected to a vortex flow formed by rotating impeller wheel 19. In particular, the impeller wheel 19 imparts a centrifugal force to the particles. It is well known that the coarser particles are greatly affected by the centrifugal force and are thrown back through primary classification zone 18 and through opening 17 and tapered transition zone 43 and into the circular flow of air about the inner circumference of second annular ring 31. On the other hand, it is also well known that the smaller particles are less affected by the centrifugal force imparted by impeller wheel 19, but instead are affected to a greater extent by the inward air flow created by the vacuum that is applied to rotatable hollow tube 22. Accordingly, the fines are drawn through the impeller wheel 19 and into central hollow portion 21, upwardly through rotatable hollow tube 22 and out of the classifier through the fines discharge outlet 23.

The remainder of the feed powder stream continues over first gap 32, through first annular ring 30 and downwardly through second gap 37 to the inner circumference of second annular ring 31. In particular, first annular ring 30 has a plurality of powder directional vanes 33 which form channels 34 therethrough. The particles of the feed powder stream are directed by the directional vanes 33 through channels 34 and into the second gap 37.

In case of relatively low air flow rate operations, the solid annular ring 50 is used. As there are no vanes in this ring, the remainder of the feed powder stream continues across first gap 32 through the tapered transition zone 43 and then into the inner circumference of the second annular ring 31. Of course, rings 30 and 31 are stationary and the classification of the particles is achieved by the vortex flow developed by the spinning rotor 10 and air guide vanes 38.

As mentioned above, a plurality of air inlets 25 are located through the housing base 26. The air entering through inlets 25 is uniformly distributed by the air distribution fins 24. The air from inlets 25 flows through air flow gap 27. Air flow gap 27 is very narrow so as to provide an "air-jetting" effect which assists in the dispersion of the powder flowing into opening 17.

Further, air is introduced into the chamber 41 through air inlets 40 or the circumferential slot 52. The air entering through the air inlet(s) flows through second annular ring 31 via channels 39, so as to form a circular flow of air about the inner circumference of second annular ring 31 and a radially inward flow of air through transition zone 43 and opening 17. Preferably, transition zone 43 has an inwardly tapered shape so as to enhance the separation therein. A secondary classification occurs at the inner circumference of second annular ring 31, where coarse particles in the powder stream are caught in the circular flow of air about the inner circumference of second annular ring 31, where they remain in the air flow until they are discharged into cyclone 42.

As discussed above, the smaller particles are less affected by the centrifugal force, but instead are affected to a greater extent by the drag force of the radially inward air current. Accordingly, the smaller particles are directed by the radially inward flow of air, through tapered transition zone 43 and through opening 17 into classification zone 18, where the particles merge with the particles that have passed through first gap 32. The particles are then subject to a vortex flow primary classification as discussed above, wherein the impeller wheel imparts a centrifugal force to the particles such that the larger particles are thrown back through opening 17 and tapered transition zone 43 and into the circular flow of air along the inner circumference of second annular ring 31, where they continue to travel until they are ultimately discharged into the cyclone 42. The fines travel inwardly through impeller wheel 19, into central hollow area 21, upwardly through hollow tube 22 and are discharged through fines outlet 23.

The particle size of the fines fraction obtained in this primary classification step can be controlled by parameters such as, but not limited to, the air flow rate through the rotor, and the speed of the classifier rotor. These parameters may be adjusted to obtain the desired particle size of the fines fraction obtained by this classification step.

Another feature of the invention is shown in FIG. 1. When additional air flow into the interior portion is needed to convey the feed powder, this air can be provided by an opening 75 provided in feed inlet 3. This opening is covered by a clip 77 which blocks the entry of air but which is movable to expose a greater portion of the opening and thus allow greater air to enter into inlet 3. Other designs can be used to achieve this function, if desired. Depending upon the type of feed materials, a sufficient amount of air is required to prevent sticking or agglomeration. One of ordinary skill in the art can determine the appropriate size of the opening to allow sufficient air to enter to avoid these problems.

EXAMPLES

The following examples are provided to illustrate the advantages of the classifier of the present invention compared to an existing apparatus of the same scale. The parameters affecting classifier performance at a selected classifier rotor speed and total airflow rate are also shown.

Example 1

A performance comparison between the classifier device of the present invention and a conventional device was conducted on a test material of silica powder having a particle size ($D_{97}$) of less than 10 microns. The speed of the classifier rotor in each device was 3000 rpm, and a total airflow rate of 150 scfm was used. Results are shown below in Table 1.

TABLE 1

| Characteristic | Present Invention | Conventional Device |
|---|---|---|
| Throughput capacity | 150 lb/hr. | 20 lb/hr. |
| Cut size | 2.1 microns | 2.75 microns |
| Cut sharpness | 0.83 | 0.6 |

The present invention provides a substantially increased throughput with a smaller cut size and increased cut sharpness.

Example 2

The device of the present invention was operated at different dispersion disk speeds to show the effect on classification performance. A silica powder having a particle size ($D_{97}$) of less than 10 microns was used. The throughput of powder was approximately 150 lb/hr. The speed of the classifier rotor was 3000 rpm and the total airflow rate was 150 scfm. The cut size and cut sharpness was measured for different dispersion disk speeds. Results are shown below in Table 2.

TABLE 2

| Dispersion Disk Speed | 1000 rpm | 2000 rpm | 3000 rpm | 4000 rpm |
|---|---|---|---|---|
| Cut size | 2.25 microns | 2.25 microns | 2.1 microns | 2.1 microns |
| Cut sharpness | 0.47 | 0.71 | 0.83 | 0.8 |

Generally, higher dispersion disk speeds resulted in a lower cut size and increased cut sharpness. Optimum performance was found to be at a dispersion disk speed of 3000 rpm in this test.

Example 3

The effect of using different dispersion disks on classifier performance was measured. The test material was a silica powder ($D_{97}$) of less than 10 microns. The speed of the classifier rotor was 3000 rpm, the total airflow rate was 150 scfm and the throughput capacity was approximately 150 lb/hr. Three different types of dispersion disks were used:

Type I—a dispersion disk having 16 dispersion blades as generally shown in FIG. 3B.

Type II—a solid dispersion disk without blades.

Type III—a dispersion disk having 8 dispersion blades of narrower dimensions than those of Type I Each disk was rotated a speed of 2000 rpm. Results on cut size and cut sharpness are shown in Table 3.

TABLE 3

| Characteristic | Type I Disk | Type II Disk | Type III Disk |
|---|---|---|---|
| Cut size | 2.25 microns | 2.2 microns | 2.1 microns |
| Cut sharpness | 0.71 | 0.62 | 0.88 |

This illustrates how different dispersion disks can be designed to obtain different cut sizes or cut sharpness characteristics. The best performance in this test was exhibited by the Type III dispersion disk.

What is claimed is:

1. A powder classifier for classifying powder particles from a feed powder stream, the classifier comprising:

a primary classifier rotor fixedly secured to a rotatable shaft and having:

(i) an interior portion defined by an upper plate and a lower plate, wherein said upper plate has upper and lower surfaces and an outer edge therebetween with the outer edge having an arcuate shape from the upper surface to the lower surface to provide a rounded outer edge along its outer circumference, and wherein said interior portion is in communication with a fine particle discharge outlet;

(ii) a plurality of vanes disposed between said upper plate and said lower plate, wherein said vanes form a plurality of channels extending radially outward from said rotatable shaft; and (iii) a rotating, primary classification zone defined by said upper plate, said lower plate, said vanes, and said outer circumference of said upper plate, which contains an inwardly spiraling forced vortex centrifugal flow field created by the vanes;

a first annular ring having an inner circumference, an outer circumference, an upper surface and a lower surface, wherein said first annular ring surrounds the outer circumference of the classifier rotor to create a preclassifying first gap between the first annular ring and the classifier rotor, such that a fraction of fine particles is separated from the feed powder stream and flows through said preclassifying first gap and into the interior portion of the primary classifier rotor for primary classification; and a second annular ring having an inner circumference, an outer circumference, an upper surface and a lower surface, wherein the second annular ring is disposed about the outer circumference of the first annular ring such that a second gap is formed between the outer circumference of the first annular ring and the inner circumference of the second annular ring such that a secondary classification occurs at said inner circumference of said second annular ring to separate coarse particles from fine particles.

2. The powder classifier of claim 1, further comprising a transition portion beneath the first annular ring having an inwardly tapered configuration in order to enhance particle separation therein.

3. The powder classifier of claim 2, wherein the first annular ring is a solid ring having upper and lower surfaces and the lower surface includes the inwardly tapered configuration.

4. The powder classifier of claim 1, wherein the second annular ring further comprises a plurality of air guide vanes located between the upper surface and lower surface thereof, wherein said air guide vanes form a plurality of channels through the second annular ring.

5. The powder classifier of claim 4, wherein the air guide vanes are evenly spaced from each other and positioned such that a radial vector projecting from the center of the classifier rotor intersects a vector projecting along the centerline of an air guide vane to form an angle $\beta$ which is between about 60 to 90°.

6. The powder classifier of claim 1, wherein the first annular ring includes a hollow central opening and the second annular ring is mounted on the housing.

7. The powder classifier of claim 6, wherein the first annular ring is a solid annular ring.

8. The powder classifier of claim 6, wherein the first annular ring further comprises a plurality of powder directional vanes located between the upper surface and lower surface thereof, wherein said powder directional vanes form a plurality of channels through the first annular ring.

9. The powder classifier of claim 8, wherein the powder directional vanes are evenly spaced from each other and positioned such that a radial vector projecting from the center of the classifier rotor intersects a vector projecting along the centerline of a powder directional vane to form an angle $\alpha$ which is between about 0 and 90°.

10. The powder classifier of claim 6, wherein the lower surface of the first annular ring is located below the upper surface of the second annular ring, and wherein the first gap is from about 1 mm to about 5 mm wide and the second gap is from about 6 mm to about 16 mm wide.

11. The powder classifier of claim 1, wherein the rotatable shaft comprises a coaxial shaft which comprises an inner shaft and an outer hollow shaft, and wherein said powder classifier further comprises separate drive means for the inner shaft and the outer hollow shaft.

12. The powder classifier of claim 1, which further comprises a housing within which the classifier rotor, first annular ring and second annular ring are disposed, and at least one opening in the housing for introducing air therein.

13. The powder classifier of claim 12, wherein a plurality of openings are provided in the housing for introducing air therein.

14. The powder classifier of claim 12, wherein the vanes through said primary classifier rotor are canted and positioned at an angle $\gamma$ of about 0° to about 45° from the radial direction of said impeller wheel.

15. The powder classifier of claim 12, wherein a plurality of air distribution fins are located on a lower surface of the classifier rotor.

16. The powder classifier of claim 12, wherein the at least one housing opening is a circumferential slot for uniform distribution of air into the housing.

17. The powder classifier of claim 12, which further comprises a feed inlet for introducing feed material into the housing, said feed inlet including an adjustable opening for adjustably introducing air into the feed inlet.

18. A powder classifier for classifying powder particles from a feed powder stream, the classifier comprising:

a rotatable coaxial shaft which comprises an inner shaft and an outer hollow shaft;

separate drive means for the inner shaft and the outer hollow shaft;

a primary classifier rotor fixedly secured to the rotatable shaft and having:

(i) an interior portion defined by an upper plate and a lower plate, wherein said upper plate has a rounded outer edge along its outer circumference, and wherein said interior portion is in communication with a fine particle discharge outlet; and (ii) a plurality of vanes disposed between said upper plate and said lower plate, wherein said vanes form a plurality of channels extending radially outward from said rotatable shaft;

(iii) a rotating, primary classification zone defined by said upper plate, said lower plate, said vanes, and said outer circumference of said upper plate, which contains an inwardly spiraling forced vortex centrifugal flow field created by the vanes; and a first annular ring having an inner circumference, an outer circumference, an upper surface and a lower surface, wherein said first annular ring surround the outer circumference of the classifier rotor to create a preclassifying first gap between the first annular ring and the classifier rotor, such that a fraction of the fine particles is separated from the feed powder stream and flows through said preclassifying first gap and into the interior portion of the primary classifier rotor for primary classification; and a rotary dispersion disk located above the upper plate of the primary classifier rotor to help disperse the powder particles from the feed powder stream, the disk being secured to the inner shaft by a fist hub assembly, wherein the classifier rotor and the dispersion disk can be independently driven at different speeds to facilitate separation, dispersion and classification of the powder particles.

19. The powder classifier of claim 18, wherein the dispersion disk further comprises a plurality of replaceable dispersion blades positioned on the upper surface thereof; and wherein the classifier rotor is secured to the outer hollow shaft by a second hub assembly.

20. The powder classifier of claim 19, wherein the upper plate and the lower plate of the classifier rotor are generally circular in shape; the upper and lower plates are connected by a second hub assembly; and the upper plate comprises a downwardly sloping annular outer portion while the lower plate comprises an upwardly sloping annular outer portion.

21. The powder classifier of claim 20, wherein the downwardly sloping annular outer portion of the upper plate terminates at the rounded edge which has a semi-circular profile.

22. The powder classifier of claim 21, wherein the first annular ring is positioned relative to the classifier rotor such that an angle $\phi$ is formed between a line from the center of the semicircle to the inner edge of the upper corner of the lower surface of the first annular ring and a line from the center of the semicircle, upwardly perpendicular to the centerline of the sloping upper plate, wherein angle is between about 30° to about 170°.

23. A powder classifier for classifying powder particles from a feed powder stream, the classifier comprising:

a primary classifier rotor fixedly secured to a rotatable shaft and having:

(i) an interior portion defined by an upper plate and a lower plate, wherein said upper plate has a rounded outer edge along its outer circumference, and wherein said interior portion is in communication with a fine particle discharge outlet;

(ii) a plurality of vanes disposed between said upper plate and said lower plate, wherein said vanes form a plurality of channels extending radially outward from said rotatable shaft;

a first annular ring having an inner circumference, an outer circumference an upper surface and a lower surface, wherein said first annular ring surrounds the outer circumference of the classifier rotor to create a preclassifying first gap between the first annular ring and the classifier rotor, such that a fraction of fine particles is separated from the feed powder stream and flows through said preclassifying first gap and into the interior portion of the primary classifier rotor for primary classification;

a second annular ring having an inner circumference, an outer circumference, an upper surface and a lower surface, wherein the second annular ring is disposed about the outer circumference of the first annular ring; and a cyclone operatively associated with the second annular ring for collecting and removing coarse particles; wherein the cyclone has an adjustable gate which is in the form of a wall member that is positionable at different angles with regard to the inner circumference of the second annular ring to optimize collection and removal of the coarse particles.

24. The powder classifier of claim 23, which further comprises an air jet positioned adjacent the cyclone opening to provide an air stream which assists in the recovery of the coarse particles.

25. A powder classifier for classifying powder particles from a feed powder stream, the classifier comprising:

a primary classifier rotor fixedly secured to a rotatable shaft and having:

(i) an interior portion defined by an upper plate and a lower plate, wherein said upper plate has upper and lower surfaces and an outer edge therebetween with the outer edge having an arcuate shape from the upper surface to the lower surface to provide a rounded outer edge along its outer circumference, and wherein said interior portion is in communication with a fine particle discharge outlet;

(ii) a plurality of vanes disposed between said upper plate and said lower plate, wherein said vanes form a plurality of channels extending radially outward from said rotatable shaft; and (iii) a rotating, primary classification zone defined by said upper plate, said lower plate, said vanes, and said outer circumference of said upper plate, which contains an inwardly spiraling forced vortex centrifugal flow field created by the vanes;

a first annular ring having an inner circumference, an outer circumference, an upper surface and a lower surface, wherein said first annular ring surrounds the outer circumference of the classifier rotor to create a preclassifying first gap between the first annular ring and the classifier rotor, such that a fraction of fine particles is separated from the feed powder stream and flows through said preclassifying first gap and into the interior portion of the primary classifier rotor for primary classification.

* * * * *

UNITED STATES PATENT AND TRADEMARK OFFICE

CERTIFICATE OF CORRECTION

PATENT NO. : 6,276,534 B1
DATED : August 21, 2001
INVENTOR(S) : Huang et al.

It is certified that error appears in the above-identified patent and that said Letters Patent is hereby corrected as shown below:

Column 15,
Line 10, change "surround" to -- surrounds --
Line 13, after "fraction of", delete "the"
Line 47, after "wherein angel", insert -- Φ --

Signed and Sealed this

Twenty-sixth Day of February, 2002

*Attest:*

*Attesting Officer*

JAMES E. ROGAN
*Director of the United States Patent and Trademark Office*